United States Patent [19]

Gabe

[11] Patent Number: 4,750,670

[45] Date of Patent: Jun. 14, 1988

[54] RIDING CROPS

[76] Inventor: Francois-Xavier Gabe, 3 rue du Coteau, Saint Laurent sur Sevre, 5890 Mortagne sur Sevre, France

[21] Appl. No.: 901,781

[22] Filed: Aug. 29, 1986

[30] Foreign Application Priority Data

Sep. 12, 1985 [FR] France ..... 85 13525

[51] Int. Cl.[4] ..... B68B 11/00

[52] U.S. Cl. ..... 231/2 R; 446/422

[58] Field of Search ..... 119/151, 152, 153, 154; 231/1, 2 R, 5, 6, 7; 446/415, 421, 422

[56] References Cited

U.S. PATENT DOCUMENTS 3,019,553 10/1953 Gomez et al. ..... 446/422
3,157,000 4/1962 Stavig ..... 446/422 X
4,394,956 7/1983 Andrews et al. ..... 231/7
4,463,517 8/1984 Kerr et al. ..... 446/421

FOREIGN PATENT DOCUMENTS 3129097 2/1983 Fed. Rep. of Germany .
728380 4/1955 United Kingdom .

*Primary Examiner*—Robert P. Swiatek
*Assistant Examiner*—R. Thomas Price
*Attorney, Agent, or Firm*—Young & Thompson

[57] ABSTRACT

The present invention relates to riding clappers crops, in which the clapper (1) is made, at least partly, of molded material the mass of which surrounds at least the adjacent end of the crop (2) in order to provide the fixation of the two parts to each other.

5 Claims, 1 Drawing Sheet

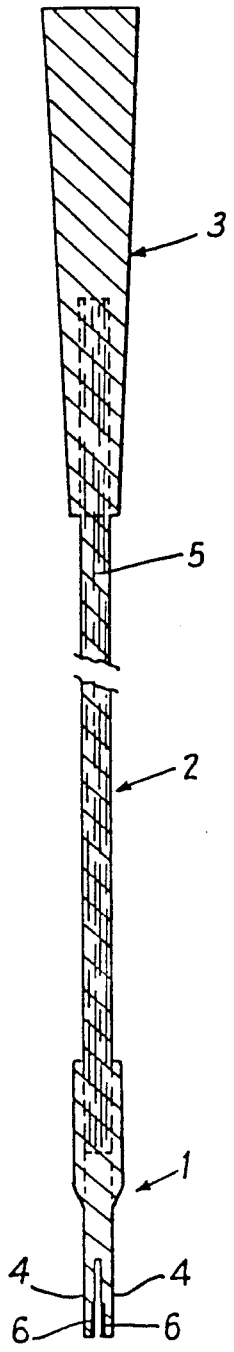
3
5
2
1
4
4
6
6

RIDING CROPS

FIELD OF THE INVENTION

In known manner, riding crops comprise a flexible stem or stock formed of a core which, in modern crops, is most often made of glass fibers surrounded by an envelope which is generally braided. At one end of said flexible stock is a handle which can include or be made substantially of a tassle. At the other end of the stock is fixed, mainly in sports crops, a part called "clapper" made of two leather tongs which strike each other and produce a smacking sound when a blow is given with the crop. This sound enhances the horse's nervous stimulation caused by the flogging.

The manufacture of such a riding crop is complex and it wears out most often due to the clapper coming loose from the stock, or to the rupture of the stock, the envelope being not sufficiently connected to the core to reinforce it usefully.

OBJECT AND SUMMARY OF THE INVENTION

The object of the present invention is to simplify the manufacture of riding clapper crops and to remedy the disadvantages of the standard crops.

According to the invention, the clapper is made at least partially of a molded material the mass of which imbeds at least the end which is adjacent the stock in order to ensure the fixation of said two parts to each other.

To improve the connection of the clapper to the stock, the molded material forming the latter is compatible, that is it seals itself when setting, with the material forming at least the peripheral layer of the stock.

According to an embodiment, the stock is made of a core of a flexible material, for example a stock made of glass fibers, and the envelope is simultaneously molded with the clapper in order to provide an integral stock envelope and clapper.

With some moldable materials, it is possible to omit the core, the stock and the clapper being made of the same homogeneous material.

In order to make manufacture easier and to notably reduce the molds size, the stock can be extruded in great lengths, with a peripheral layer of a material compatible with that of the clapper, and is cut to length prior to the overmolding of the clapper and possibly of the handle. According to this embodiment, it is possible to use a stock made of a thermoplastic material reinforced with fibers according to the so-called poltrusion extrusion technique of a fibrous mixture, the fibers being oriented longitudinally with respect to the extruded profile by passing through the extrusion die.

The handle is preferably also molded in a material compatible with the material forming at least the stock peripheral layer.

The material forming the clapper, at least the stock envelope and possibly the handle, can be of any sort provided it exhibits a sufficient resiliency. It can be a vinylic resin, an acrylic resin, a polyurethane, a natural or synthetic rubber, etc.

It may be possible that the material forming the clapper does not provide naturally a sufficient sonority during the impact of the two tongs. To remedy this situation, it is possible to imbed in the faces of the tongs which are opposite each other inserts made of a hard plastic material, wood, metal, etc.

BRIEF DESCRIPTION OF THE DRAWING

An embodiment of the riding crop according to the invention will be made more apparent from its description, with reference to the accompanying drawing which is a longitudinal sectional view thereof.

DETAILED DESCRIPTION OF THE INVENTION

The riding crop includes in known manner a goad or clapper designated by reference numeral 1, a crop 2 and a handle 3. Clapper 1 includes two tongs 4 which are separated by a clearance and which have, in a plane perpendicular to the plane of the drawing, a shape which is substantially trapezoidal and broadens toward the end, with rounded corners.

The riding crop 2 is made of a length of a cylindrical rod obtained by extrusion of a plastic material mass loaded with fibers. The fibers 5 are made parallel and provide a good mechanical strength, as well as a good flexibility.

Clapper 1 is overmolded on an end of the stock, preferably with the same plastic material as the mass of stock 2, so that, as shown, there occurs an interpenetration of the materials which form a block. An insert 6 made of a small plaquette of a rigid plastic material, a metal or the like, is imbedded during molding inside each of the opposite surfaces of tongs 4 in order to increase the sonority of the smacking sound.

Handle 3 is molded in the same material as the clapper, the fiber bundle 5 of that end of the stock being imbedded in the plastic material mass.

I claim:

1. A riding clapper crop, comprising an elongated shank, a handle at one end of the shank, and a clapper at the opposite end of the shank, the shank being of moldable plastic material, and the clapper being of a compatible plastic material over-molded by casting on said opposite end of the shank, said shank consisting of glass fibers embedded in plastic, said handle being of a plastic material compatible with said shank and over-molded by casting on said one end of said shank.

2. A riding crop as claimed in claim 1, in which said compatible plastic material is the same as the plastic material of said shank.

3. A riding crop as claimed in claim 1, in which said compatible plastic material is the same as the plastic material of said shank.

4. A riding crop as claimed in claim 1, in which said handle and clapper are both of the same plastic material as the plastic material of the shank and are over-molded on opposite ends of the shank.

5. A riding crop as claimed in claim 1, the clapper having two normally-spaced portions adapted to strike each other, said spaced portions being of a material harder than the plastic material of the clapper and being molded in the plastic material of the clapper on confronting surfaces of said spaced portions.

* * * * *